US005555591A

United States Patent [19]

Chang

[11] Patent Number: 5,555,591

[45] Date of Patent: Sep. 17, 1996

[54] BATH SCRUBBER

[76] Inventor: Che-Yuan Chang, No. 1, Lane 147, Sec. 2, Chung San Rd., Yun Lin, Chang Hua Hsien, Taiwan

[21] Appl. No.: 547,156

[22] Filed: Oct. 24, 1995

[51] Int. Cl.[6] ..... A47K 7/02

[52] U.S. Cl. ..... 15/210.1; 15/222; 601/137; 601/138

[58] Field of Search ..... 15/208, 209.1, 15/210.1, 211, 222, 229.11, 229.12, 229.13, 229.14; 601/138, 137

[56] References Cited

U.S. PATENT DOCUMENTS

| | | | |
|---|---|---|---|
| 1,657,744 | 1/1928 | Durkee | 15/208 |
| 1,714,687 | 12/1929 | Theodoropulos | 15/222 |
| 2,737,679 | 3/1956 | Choma | 15/222 |
| 3,343,196 | 9/1967 | Barnhouse | 15/229.11 |
| 3,959,841 | 6/1976 | Horne | 15/222 |
| 3,977,796 | 8/1976 | Gillespie | 15/222 |
| 5,295,280 | 3/1994 | Hudson et al. . | |

FOREIGN PATENT DOCUMENTS

| | | | |
|---|---|---|---|
| 1029241 | 1/1989 | Japan | 15/222 |

*Primary Examiner*—Frankie L. Stinson
*Assistant Examiner*—Randall E. Chin
*Attorney, Agent, or Firm*—Browdy and Neimark

[57] ABSTRACT

A bath scrubber comprises scrubbing nets, fastening members, and at least one connection member. The scrubbing nets are provided with an axial hole and are curved respectively along the axis thereof such that the outer edges of the scrubbing nets are corrugated irregularly. The scrubbing nets are held in series by the fastening members such that the axial hole is separated into a first through hole and a second through hole, in which the connection member is received so as to enable the scrubbing nets to be located easily and securely on a bather's body at the time when the bath scrubber is at work.

4 Claims, 2 Drawing Sheets

BATH SCRUBBER

FIELD OF THE INVENTION

The present invention relates generally to a bath tool, and more particularly to a beltlike bath scrubber having a better cleaning effect and less vulnerable to being twisted.

BACKGROUND OF THE INVENTION

The U.S. Pat. No. 5,295,280 discloses a flexible bath scrubber which is composed of a plurality of cylindrical elastic nets and two fastening bands. Such a prior art bath scrubber as referred to above has inherent shortcomings, which are described explicitly hereinafter.

The elastic nets of the prior art bath scrubber are curved in the same direction so that only the outermost layer of the elastic nets makes contact with the skin surface of a person who takes a bath. The meshes of the outermost layer of the elastic nets are similar in orientation, thereby making it difficult for the prior art bath scrubber to get rid of the impurities on the skin surface of the person.

The elastic nets of the prior art bath scrubber can not be located easily when a user of the bath scrubber holds two fastening bands located at both ends of elastic nets. As a result, the cleaning effect of the prior art bath scrubber is greatly compromised.

SUMMARY OF THE INVENTION

It is therefore the primary objective of the present invention to provide a bath scrubber which has a better scrubbing effect.

It is another objective of the present invention to provide a bath scrubber capable of being located easily on a bather's body.

The foregoing objectives of the present invention are attained by a bath scrubber, which comprises a plurality of cylindrical scrubbing nets of a predetermined length, a plurality of fastening members, and a connection member. The scrubbing nets are provided respectively with an axial hole and are respectively curved continuously along the axis thereof such that the outer edges of the scrubbing nets are corrugated. The scrubbing nets are held by the fastening members such that the axial hole is separated into a first through hole and a second through hole. The connection member is received in the first and the second through holes for fastening the scrubbing nets in series so that the scrubbing nets can be located easily and securely on a bather's body at the time when the bath scrubber is at work.

DETAILED DESCRIPTION OF THE INVENTION

Figure 2:
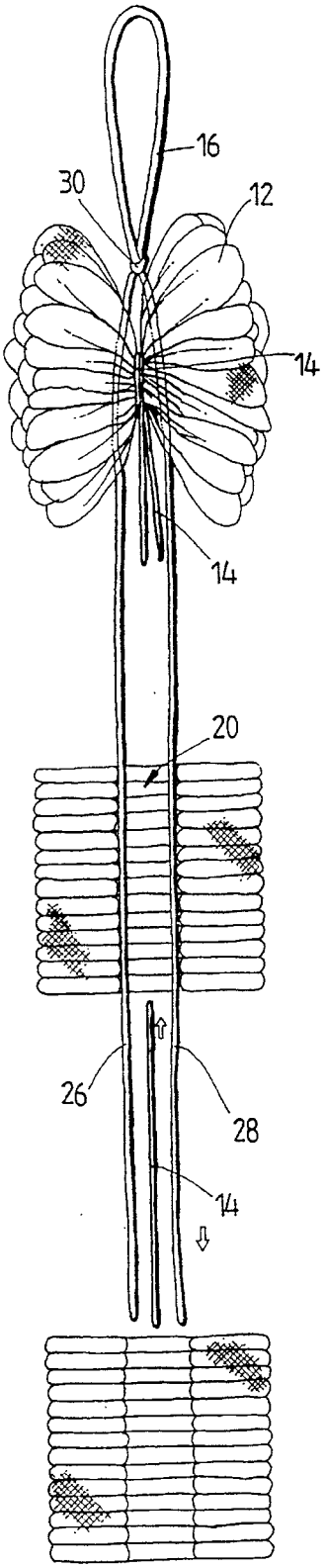
FIG. 2 shows a schematic sectional view taken along the direction of the longitudinal axis of the first preferred embodiment of the present invention.
Figure 1:
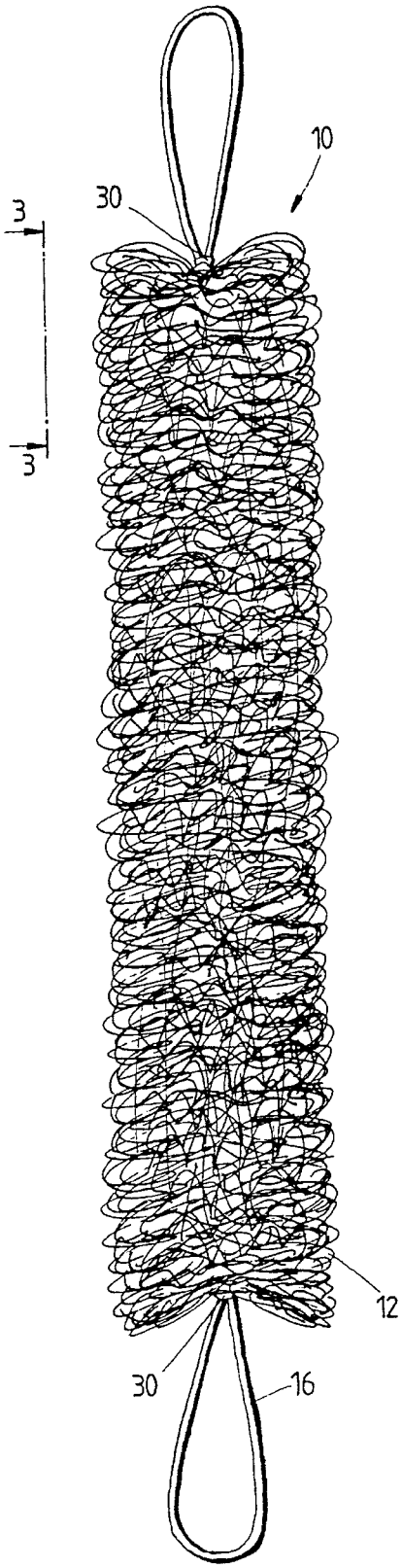
FIG. 1 shows a front view of a first preferred embodiment of the present invention.

As shown in FIGS. 1–4, a bath scrubber 10 of the first preferred embodiment of the present invention is of a beltlike construction and is composed of a plurality of scrubbing nets 12, a plurality of fastening members 14, and a connection member 16.

The scrubbing nets 12 of an appropriate length are of a cylindrical construction and are provided respectively with an outer edge portion which is corrugated in the direction of the longitudinal axis of the scrubbing net 12. The cylindrical scrubbing nets 12 are further provided respectively with an axial hole 20.

Each of the fastening members 14 is in fact a short cord, which is intended to fasten securely the scrubbing nets 12 by passing through the outer edge portion and the central portions of both upper and lower ends of the scrubbing nets 12. As a result, each scrubbing net 12 is spherical in shape. Each axial hole 20 is separated by each fastening member 14 into a first through hole 22 and a second through hole 24, which are parallel to each other.

The connection member 16 is in fact an elastic cord of a plastic material and provided respectively at both ends thereof with a ring. The scrubbing nets 12 are connected by the connection member 16, which is provided in the mid-section thereof with a first line segment 26 and a second line segment 28. The scrubbing nets 12 are fastened in series by the connection member 16 in such a manner that the first line segment 26 and the second line segment 28 are received respectively in the first through hole 22 and the second through hole 24. The first and the second line segments 26 and 28 extend to form two fixation portions 30 between which the scrubbing nets 12 are held.

The bath scrubber 10 of the present invention has inherent advantages, which are expounded explicitly hereinafter.

The corrugated outer edge portions of the scrubbing nets 12 of the bath scrubber 10 of the present invention has an excellent scrubbing effect on the body skin of a bather.

The outer edge portions of the scrubbing nets 12 have meshes which are oriented variously so as to enhance the scrubbing effect of the outer edge portions of the scrubbing nets 12 of the bath scrubber 10 of the present invention. In addition, the scrubbing nets 12 of the bath scrubber 10 have an excellent scrubbing effect by virtue of the fact that the scrubbing nets 12 are provided respectively with an irregularly corrugated or petaloid outer edge.

The bath scrubber 10 of the present invention can be easily located on the body skin of a bather, thanks to the traction provided by the first line segment 26 and the second line segment 28 of the connection member 16.

Figure 5:
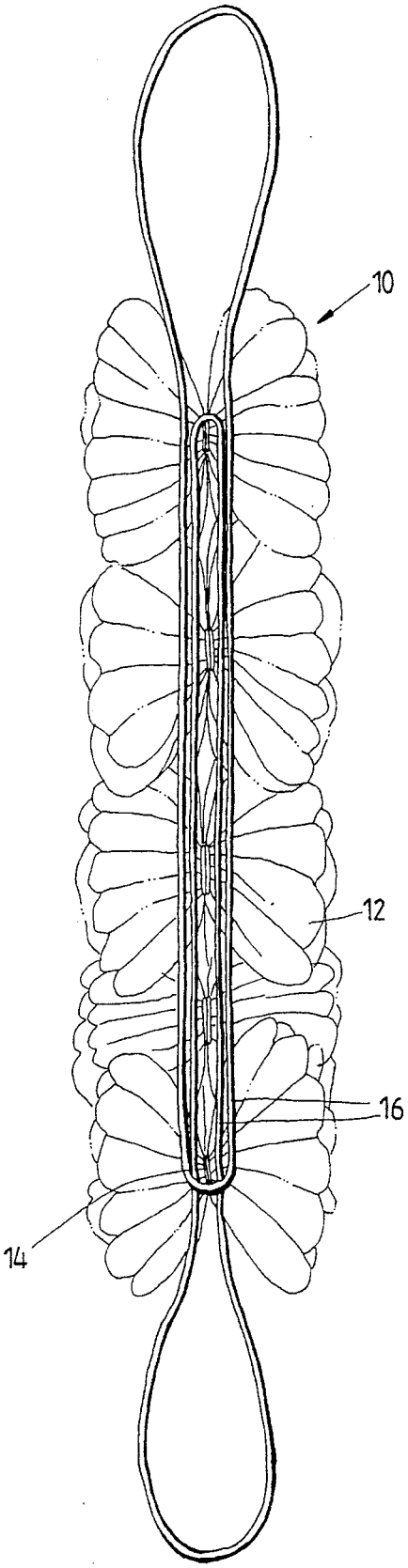
FIG. 5 shows a schematic sectional view taken along the direction of the longitudinal axis of a second preferred embodiment of the present invention.
Figure 3:
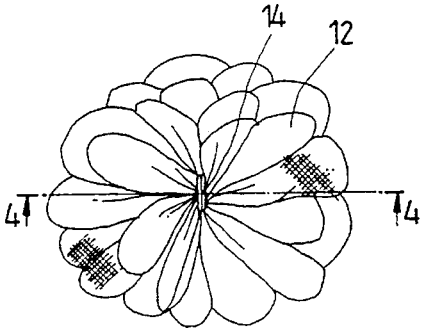
FIG. 3 shows a sectional view of a portion taken in the direction indicated by the line 3—3 as shown in FIG. 1.
Figure 4:
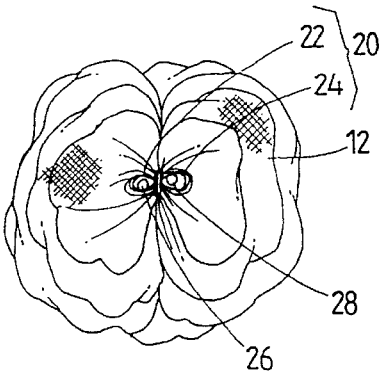
FIG. 4 shows a sectional view of a portion taken in the direction indicated by the line 4—4 as shown in FIG. 3.

As illustrated in FIG. 5, the second preferred embodiment of the present invention is different from the first preferred embodiment of the present invention in that the former is devoid of the fixation portions 30, and that the former has the connection member 16 made up of two cords which are received in the first and the second through holes 26 and 28 and can be pulled in opposite directions to cause the scrubbing nets 12 to become so packed as to enhance the scrubbing effect of the bath scrubber.

The embodiments of the present invention described above are to be regarded in all respects as merely illustrative and not restrictive. Accordingly, the present invention may be embodied in other specific forms without deviating from the spirit thereof. The present invention is therefore to be limited only by the scopes of the following appended claims.

What is claimed is:

1. A bath scrubber, which comprises:

a plurality of scrubbing nets of a cylindrical construction, said scrubbing nets having therein an axial hole and corrugated outer edge portions;

a plurality of fastening members for fastening said scrubbing nets such that said axial hole is separated by said fastening members into a first through hole and a second through hole; and at least one connection member provided in a midsection thereof with a first line segment and a second line segment, which are received respectively in said first through hole and said second through hole.

2. The bath scrubber as defined in claim 1, wherein said scrubbing nets can be pulled in opposite directions so as to cause said corrugated outer edge portions of said scrubbing nets to become pleated irregularly.

3. The bath scrubber as defined in claim 1, wherein said first and second line segments are provided at opposite ends thereof with fixation portions; and wherein said scrubbing nets are fastened in series between said fixation portions.

4. The bath scrubber as defined in claim 3, wherein said fixation portion is formed by said first line segment and said second line segment, which are intertwined.

* * * * *